US005952920A

United States Patent [19]

Braddick

[11] Patent Number: 5,952,920

[45] Date of Patent: Sep. 14, 1999

[54] CURRENCY ANTI-THEFT DEVICE

[75] Inventor: Kenneth J. Braddick, Bennington, Vt.

[73] Assignee: Mace Security International, Bennington, Vt.

[21] Appl. No.: 09/106,577

[22] Filed: Jun. 29, 1998

[51] Int. Cl.[6] ..... G08B 13/14

[52] U.S. Cl. ..... 340/568.1; 340/571; 340/539; 340/570; 109/2

[58] Field of Search ..... 340/571, 568, 340/539, 570, 572; 102/367, 368; 109/2, 5, 6, 10, 21; 558/374

[56] References Cited

U.S. PATENT DOCUMENTS

| | | | |
|---|---|---|---|
| 3,564,525 | 2/1971 | Robeson et al. | 340/571 |
| 3,715,379 | 2/1973 | Berry, Jr. et al. | 558/374 |
| 3,795,197 | 3/1974 | Levenson | 102/368 |
| 3,828,341 | 8/1974 | Carter, Jr. et al. | 340/571 |
| 4,268,823 | 5/1981 | Rauchut et al. | 340/570 |
| 4,461,221 | 7/1984 | Schandle et al. | 109/6 |
| 4,604,607 | 8/1986 | Sanderfored, Jr. et al. | 340/539 |
| 4,800,369 | 1/1989 | Gomi et al. | 340/572 |
| 5,485,143 | 1/1996 | Keniston | 340/568 |

*Primary Examiner*—Benjamin C. Lee
*Attorney, Agent, or Firm*—Paul C. Remus, Esquire; Kristin Kohler, Esquire; Devine, Millimet & Branch, Professional Assocation

[57] ABSTRACT

A system and method to deter the theft of paper currency comprising a currency pack assembly containing coded electronics and an ignitable chemical pack. There is a coded teller sentry unit located near the cash drawer in which the currency pack assembly is stored. The currency pack assembly contains a coded transmitting/receiving apparatus that signals the coded teller sentry unit when the currency pack assembly is removed from the cash drawer. The coded teller sentry unit is connectable to a silent alarm and may trigger the silent alarm upon removal of the currency pack from the cash drawer. The coded teller sentry unit is also connectable to surveillance equipment such as cameras, and activates such equipment automatically upon removal of the currency pack assembly from the cash drawer. There is also a coded door control unit located near the egress to the building which detects when the currency pack assembly has left the building. The coded door control unit is connectable to an alarm which is sounded upon removal of the currency pack assembly from the building, and is connectable to a door locking mechanism which locks the doors of the building after the currency pack assembly has left the building. Once the currency pack assembly has left the building, a microprocessor in the currency pack assembly begins timing down to a pre-set ignition time to ignite the chemical pack. The chemical pack contains chemical dye, colored smoke, and, where permitted by law, teargas. The system can provide notification to law enforcement personnel or other monitoring systems, prevent re-entry of the thief into the building, and ideally induce the thief to abandon the stolen currency.

17 Claims, 3 Drawing Sheets

CURRENCY ANTI-THEFT DEVICE

FIELD OF THE INVENTION

The invention relates generally to deterring theft of paper currencies from financial institutions and other facilities. More particularly, the invention relates to systems comprising electronic transmitter/receiver components and chemical dye packs in a single system. Most particularly the system includes a radio transmitter/receiver door control unit located near the egress of a facility, a radio transmitter/receiver and chemical pack of pyrotechnic dyes, with or without teargas agent, enclosed within a pack of currency, a teller/cashier sentry unit, located within the teller/cashier area of a facility, to electronically activate surveillance cameras and a silent and/or audible alarm immediately when the currency pack leaves the cash drawer where it is stored. The system also includes a Tester that mimics the active currency pack system, and an Ignitor Tester that mimics the system ignitor such that the full system may be tested.

BACKGROUND OF THE INVENTION

Among the devices which have been used by banks and other financial institutions to deter bank robberies, and to aid in the apprehension of a thief and the recovery of stolen monies, are security packs disguised as a strapped bundle of currency bills. Such security packs are normally kept in a teller drawer along with actual currency bills and are handed to the robber during a bank robbery. At least the top and bottom faces of the security/currency pack are actual currency bills to simulate actual bundles of currency. The disguised security packs actually conceal metal canisters containing materials including tear gas, visible dye, tracer dye, smoke and/or other active chemicals which can be discharged from the security pack to assist in the recovery of stolen monies—by marking the money, and the location of the money, and to assist in the apprehension of the thief—by marking and/or disabling the thief to mark the location of the money and the thief.

The metal canisters commonly used to contain the active chemicals that are emitted by the security pack contain a chemical mixture that is ignitable. The chemical mixture commonly contains chemicals similar to those found in a flare, and once ignited, these chemicals burn for about one minute. The metal canisters insulate the currency from the heat generated by the ignition of the chemicals.

Many methods have been used to activate the security pack and include:

- keeping the security pack in a drawer on a magnetic keeper plate such that a magnetic reed switch within the security pack disables the unit from detonating as long as the reed switch is within the influence of the magnetic keeper plate and once removed from the keeper plate, a timer is activated and at a predetermined count, the security pack is detonated;
- having a plug in the security pack that is pulled when the pack is removed from the drawer, thereby arming the security pack and starting a timer;
- using radio receivers which are tuned to receive a localized radio signal broadcast by an antenna near the doors of the institution wherein the transmitted signal is limited to the vicinity of the doors, and not to the teller area, and when the security pack is brought within the vicinity of the radio signal the transmitted signal is detected by a receiver in the security pack to arm the pack wherein the security pack may either be detonated immediately or placed on a time delay;

- using a "hold-of" circuit with the electronic system of the currency pack which prevents the security/currency pack from being detonated until the thief has left the premises; and
- using digital coding techniques to minimize the chance of inadvertent detonations, for example inside the building.

Although there are many methods for activating the chemical pack, the method for concealing the chemical pack has traditionally been the metal canister which, although it insulates the currency from the detonation, it is bulky and rigid. Electronic components on a board trigger the ignition of chemicals housed in the metal container. The electronic board and the metal container are placed within a space cut out of a currency pack that is at least 51 percent of the notes as that percentage is usually required by the issuers of currency to fulfill requirements under mutilated currency laws to reimburse at the face value of the currency. The metal chemical container usually measures about 1.85 inches by 1.85 inches by 0.45 inches. Thieves know this, and will often either fan the currency packs to see if they behave as regular currency would when being fanned, or if they are stiff and unbending. Thieves have been known to bang the currency packs against the teller counter so see if they are soft, or if they contain a hard metal canister. Thus various ways have also been devised to make the currency pack look and behave more like a regular currency pack including loosely sewing actual currency bills together such that the edges may be fanned, splitting the chemical pack into smaller segments and storing the segments at opposite ends of the currency pack such that the pack may be bent as a normal currency pack and will not feel heavier nor stiffer than a real currency pack, and adding foam cushions around the chemical canister such that the security pack will not make a sound when banged on a hard surface such as a teller counter.

Various methods of concealing the chemical pack, and of timing the detonation of the security pack were discussed above and can be found in the following U.S. Patents which are representative of the state of the art. U.S. Pat. No. 's: 5,485,143 to Kenniston for a Security Dye Pack Having Flexible Heat-Resistant Chemical Pouch; 4,639,716 to Payne for an Alarm Packet System; 5,196,828 to Kennistion for a Bendable Currency Security Dye Pack; 5,448,223 to Johnson for a Currency Alarm Pack Having Receiver Automatic Gain Hysteresis; 4,573,043 to Heuker of Hoek et al. for a Safe Guarded Lockable Container, Particularly For Transporting Money and Securities; 4,559,529 to Bernhardt for an Anti-theft System With Digitally Coded Signal; 4,511,888 to Bernhardt for a Dual Signal Electromagnetic Article Theft Detector; 5,059,949 to Caparoni et al. for a Currency Alarm Pack; 3,828,341 to Carter, Jr. et al. for an Alarm Apparatus For Facilitating The Detection Of An Unauthorized Removal Of Property; 4,604,607 to Sanderford, Jr. et al. for a Security Device Simulating Currency Pack Or The Like, and 4,327,360 to Brown for an Alarm Device Responsive To Movement Of Protected Object, Power Source Condition And Alarm Ground Path.

No security dye packs known to exist to the inventors at the time of the invention perform functions beyond the ignition of a chemical pack by a pre-set electronic timer that is triggered, by electronic transmitter/receiver means or otherwise, when the currency pack exits the premises. The weight, simple electronic procedures, the use of bulky batteries and overall size of the dye pack electronics are drawbacks to existing systems. Also no known systems can automatically trigger alarms to alert authorities to a potential or in-progress robbery when the security pack is removed from its drawer, nor can current systems lock the doors to a bank to prevent re-entry of a thief.

Thus it would be desirable to have a security dye pack system which would feel like a real currency pack, emit a chemical pack in order to stain bank notes and the thief, emit a cloud of smoke, where allowed by law, emit a disabling gas, have a transmitter/receiver mechanism to control the detonation of the chemical pack once the currency pack exits the premises, lock the facility's doors such that a thief can not re-enter the premises, have a coded transmitter/receiver mechanism to automatically activate the facility's silent or audible alarm when the security pack is removed from its storage drawer, and also to automatically activate surveillance cameras upon removal of the security pack from its storage drawer.

SUMMARY OF THE INVENTION

A preferred embodiment of the invention utilizes miniaturized transmit/receive electronics, coin-sized lithium batteries, extensive capabilities of activating electronic systems within financial institutions and an improved chemical pack to automatically activate the institution's silent and/or audible alarm by connecting a pair of wires to either of a teller/cashier sentry unit and/or a door control unit to activate the alarms when a currency pack assembly exits the cash drawer and/or the premises; notify law enforcement or monitoring units when the currency pack assembly is removed from the cash drawer; automatically activate surveillance cameras via the teller/cashier sentry unit immediately when the currency pack is removed from the cash drawer; lock at least one door fitted with an electronic locking device that does not hinder exiting the premises but prevents entry or re-entry; and trigger the timed ignition of a chemical dye pack designed look and feel like a real currency pack, to stain bank notes with colored dye thereby rendering them worthless, emit a cloud of colored smoke to pinpoint the location of the money, and, where allowed by law, emit noxious teargas to disable a thief and cause the discarding of the entire package.

The above results are accomplished by a preferred embodiment of the invention which is a system for deterring theft of paper currency. The system has a coded transmitting and receiving door control unit located by the egress of a facility. A door unit alarm and a door locking means are activatable by the door control unit. There is an ignitable chemical pack enclosed within a currency pack assembly which has a coded transmitting and receiving unit in preferably radio communication with the door control unit and which is also in preferably radio communication with a coded transmitting and receiving teller sentry unit located within the cashier area of the facility to signal immediately when the currency pack assembly leaves the cash drawer in which it is stored and an audible alarm, a silent alarm and/or surveillance systems, are activatable by the teller sentry unit. The chemical pack inside the currency pack assembly contains and emits chemicals to stain bank notes with colored dye, and pyrotechnic chemicals to emit a cloud of colored smoke to identify the location of stolen money. The chemical pack also contains and emits noxious tear gas agent to disable a person carrying the currency pack. The tear gas agent may be, for example, orthochlorobenzalmalononitrile (CS) tear gas agent.

The teller sentry unit has electrical terminals that are connectable to automatically activate surveillance systems upon removal of the currency pack assembly from the cash drawer, in response to a coded signal transmitted to it by the transmitting and receiving unit of the currency pack assembly. The surveillance systems may be, for example, surveillance camera systems or other monitoring units or systems. The teller sentry unit also has electrical terminals that are connectable to automatically activate preferably a silent alarm, and/or an audible alarm, upon removal of the currency pack assembly from the cash drawer, in response to a coded signal transmitted to it by the transmitting and receiving unit of the currency pack assembly.

The door control unit has electrical terminals that are connectable to automatically activate the door unit alarm when the door control unit receives coded signals from the transmitting and receiving unit of the currency pack assembly upon removal of the currency pack assembly from the facility. The door unit alarm may be a silent or audible alarm. The door control unit also has electrical terminals that are connectable to automatically activate the door locking means when the door control unit receives coded signals from the transmitting and receiving unit of the currency pack assembly. The door locking means locks at least one prefitted door of the facility such that no one may enter the facility but those inside the facility may exit, and the lock device is lockable upon receipt of a signal from the door control unit.

The currency pack assembly has a microprocessor which, when coded signals being transmitted by the door control unit and the transmitting and receiving unit of the currency pack assembly are no longer being received each by the other, signals the chemical pack that the currency pack assembly has left the facility and the microprocessor begins timing down to ignition of a chemical film in the chemical pack which then releases the colored dye, colored smoke, and teargas.

There is also a testing currency pack assembly for use with the system for testing the system. such that the actual chemicals and teargas need not be used or released, but wherein the radio and electronic communications of the system may be tested. There is also an ignition tester such that the system is testable completely through to ignition of the chemical pack.

The present invention is also a method for preventing theft of paper currency from a facility, comprising the steps of detecting when a currency pack assembly has left a cash drawer where it is normally stored, transmitting a coded signal to a teller sentry unit indicating that the currency pack assembly has left the cash drawer, activating a silent alarm by a signal from the teller sentry unit to the silent alarm to notify law enforcement or other monitoring units, detecting when the currency pack assembly has left the facility by having a door control unit which determines when the currency pack assembly exits the facility, sounding an audible alarm when the door control unit determines that the currency pack assembly has left the facility, locking the doors to the facility when the door control unit determines that the currency pack assembly has left the facility such that a thief may not re-enter the facility but such that people inside the facility may exit, initiating, when the door control unit has determined that the currency pack assembly has left the facility, a timing microprocessor to begin counting down to ignition of a chemical pack contained inside the currency pack assembly such that after a predetermined time, the chemical pack is ignited so that the chemical pack will never be ignited inside the facility due to the timing delay and the door locking mechanism, and emitting colored dye, smoke, and teargas to disable a thief, indicate the location of the thief and the stolen currency, mark the stolen currency such that it is readily identifiable, and disable the thief to cause the thief to drop the stolen currency.

Accordingly, one aspect of the invention is to provide an improved chemical pack that enables the currency pack assembly to look and feel more like real currency, and yet which can still disable a thief.

Another aspect of the invention is to provide activation, by way of a teller sentry unit, of a silent alarm to notify law enforcement or other monitoring units as soon as a currency pack assembly is removed from a cash drawer where it is stored.

A further aspect of the invention is to provide a silent or audible alarm, by way of a door control unit, when a currency pack assembly is removed from the facility.

A still further aspect of the inventions to provide a door locking mechanism that will lock the doors to the facility, upon instructions from the door control unit, after a currency pack assembly is removed from the building such that a thief can not re-enter the building.

Yet another aspect of the invention is to provide a delayed ignition trigger that begins counting down to ignition of the chemical pack once the currency pack assembly is removed from the building such that the chemical pack will not ignite inside the building, and, in combination with the door locking mechanism, can not be brought back into the building after it has been removed from the building.

Another aspect of the invention is to provide radio frequency communication between the currency pack assembly and the teller sentry unit, and, the currency pack assembly and the door control unit.

Still another aspect of the invention is to provide electrical communication between the teller sentry unit and a silent or audible alarm, between the door control unit and a silent or audible alarm, and, between the door unit and the door lock mechanism.

A further aspect of the invention is to provide an improved chemical pack that emits colored dye to stain bank notes and a thief, emit colored smoke to pinpoint the location of stolen bank notes and the thief, and emit teargas to disable the thief, to compel the carrier of the currency pack to discard the entire package.

Figure 1:
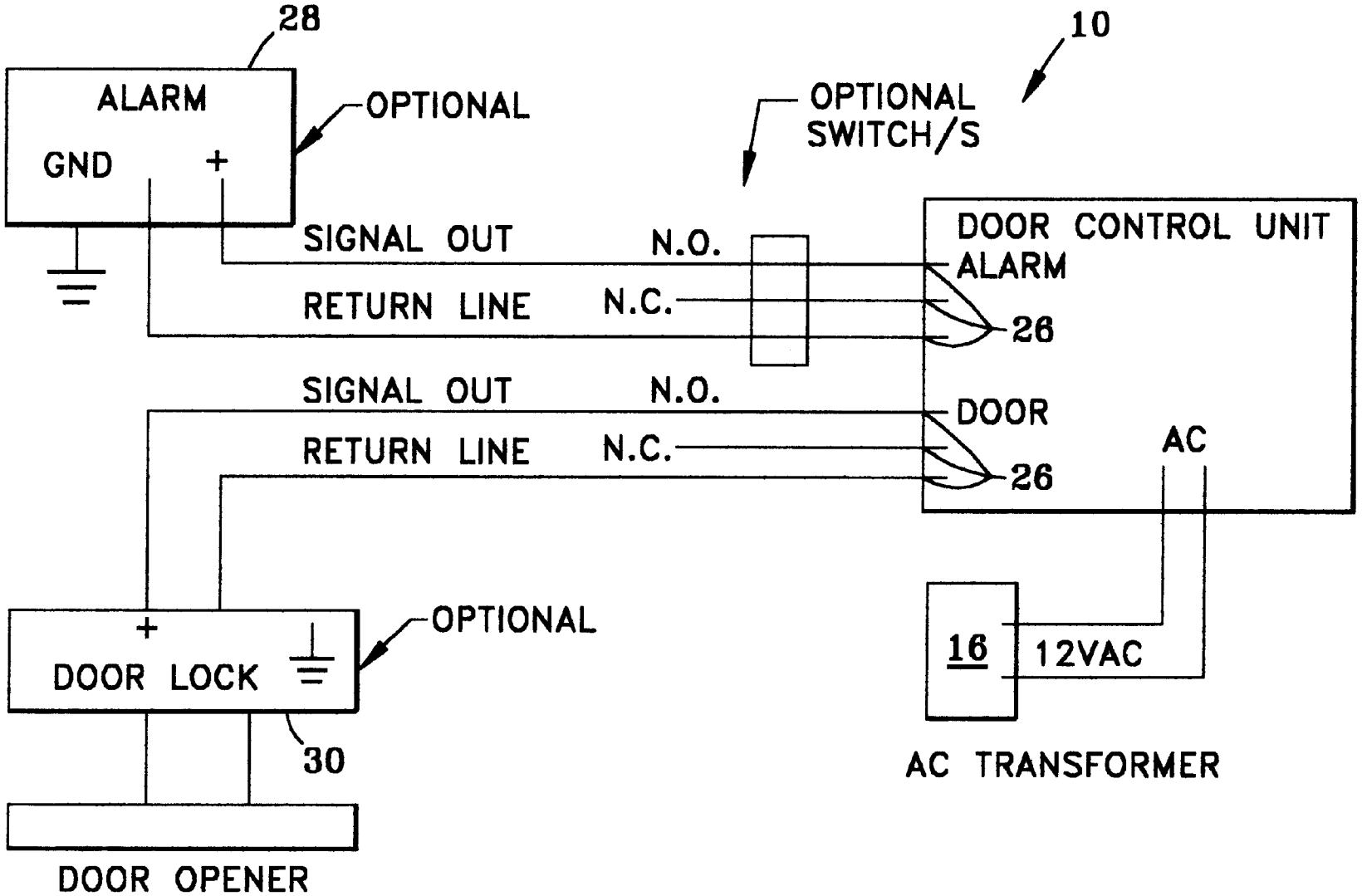
FIG. 1 is a schematic view of the Door Control Unit portion of the invention.

DETAILED DESCRIPTION OF THE INVENTION:

Referring now to the figures, in which like reference numerals refer to like elements throughout, FIG. 1 shows a schematic view of door control unit 10 which serves the multiple purposes of:

a) receiving and transmitting, preferably in the form of radio signals, coded operating instructions to and from an electronic transmitter-receiver contained inside currency pack assembly 14, b) transmitting a signal, via electrical terminals 26, to a silent or audible alarm system 28 to alert law enforcement, and/or an alarm monitoring center, that unauthorized removal of a currency pack assembly 14 from the premises of a facility, such as a financial institution, has occurred, and c) transmitting a signal to an electronic lock or other electronic device 30 that will lock at least one pre-fitted door of the facility such that those inside may exit, but those outside may not enter or re-enter.

Door control unit 10 is preferably affixed to an area near the facility's egress and broadcasts preferably a radio signal on a frequency approved by the Federal Communications Commission (FCC) that can be received by a receiver, tuned to the appropriate frequency, that is within the approximate area of the egress.

Figure 3A:
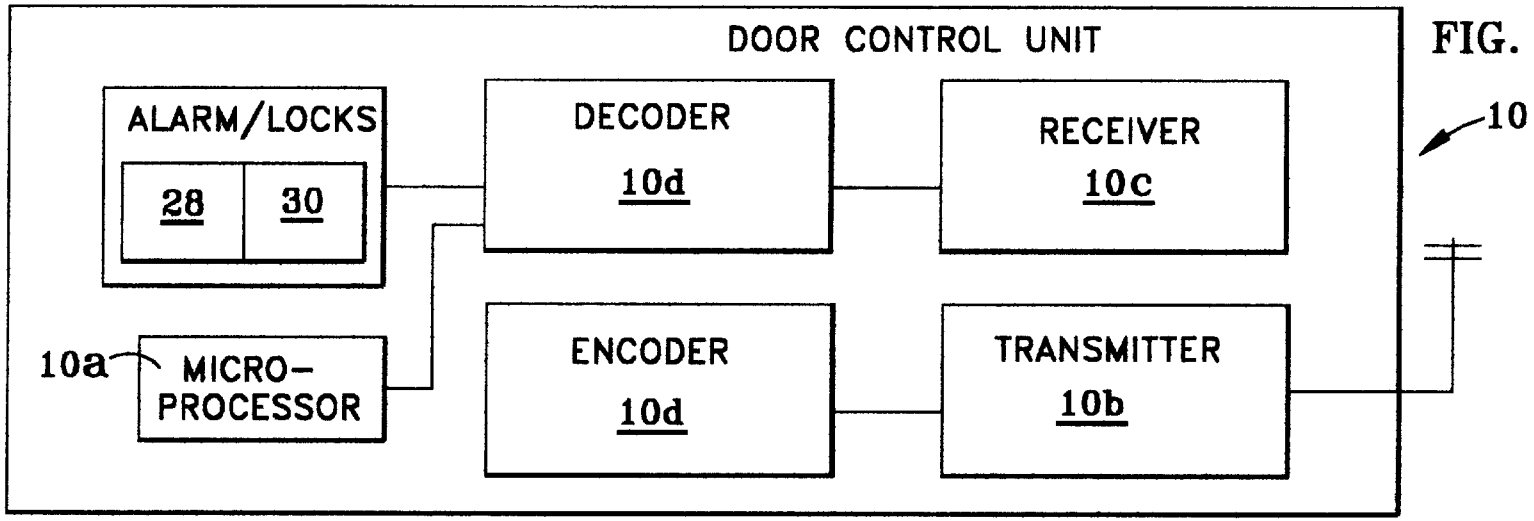
FIGS. 3*a* and 3*b* are schematic views of the electronics of the Door Control Unit (3*a*) and of the electronics housed in the currency pack assembly (3*b*).
Figure 3B:
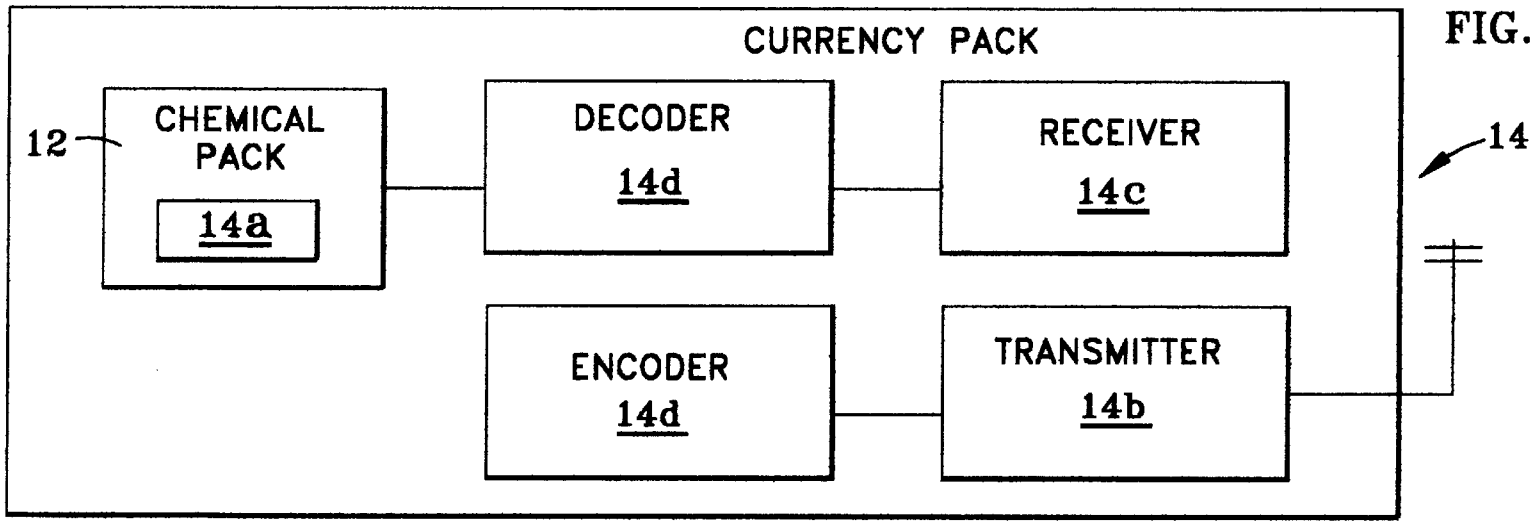

Door control unit 10 preferably operates from a 12 volt AC power source 16 and contains a microprocessor 10*a*, a transmitter 10*b* transmitting coded radio signals in the frequency of for example about 418 MHZ, a receiver 10*c* tuned to receive coded radio signals at a frequency of for example about 916 MHZ, and an encoder-decoder 10*d*, similar to the electronics contained in currency pack assembly 14 and shown in FIGS. 3*a* and 3*b*. However, door control unit 10 preferably has a battery back-up (not shown) and is capable of controlling the locking of doors, and of sending out signals to activate silent or audible alarms. When a particular embodiment of the door control unit of the invention is powered but idle, it draws about 20 mA of current, as opposed to drawing about up to 150 mA when fully activated. The electronics necessary to form the door control unit would be known to those of ordinary skill in the relevant art.

Figure 2:
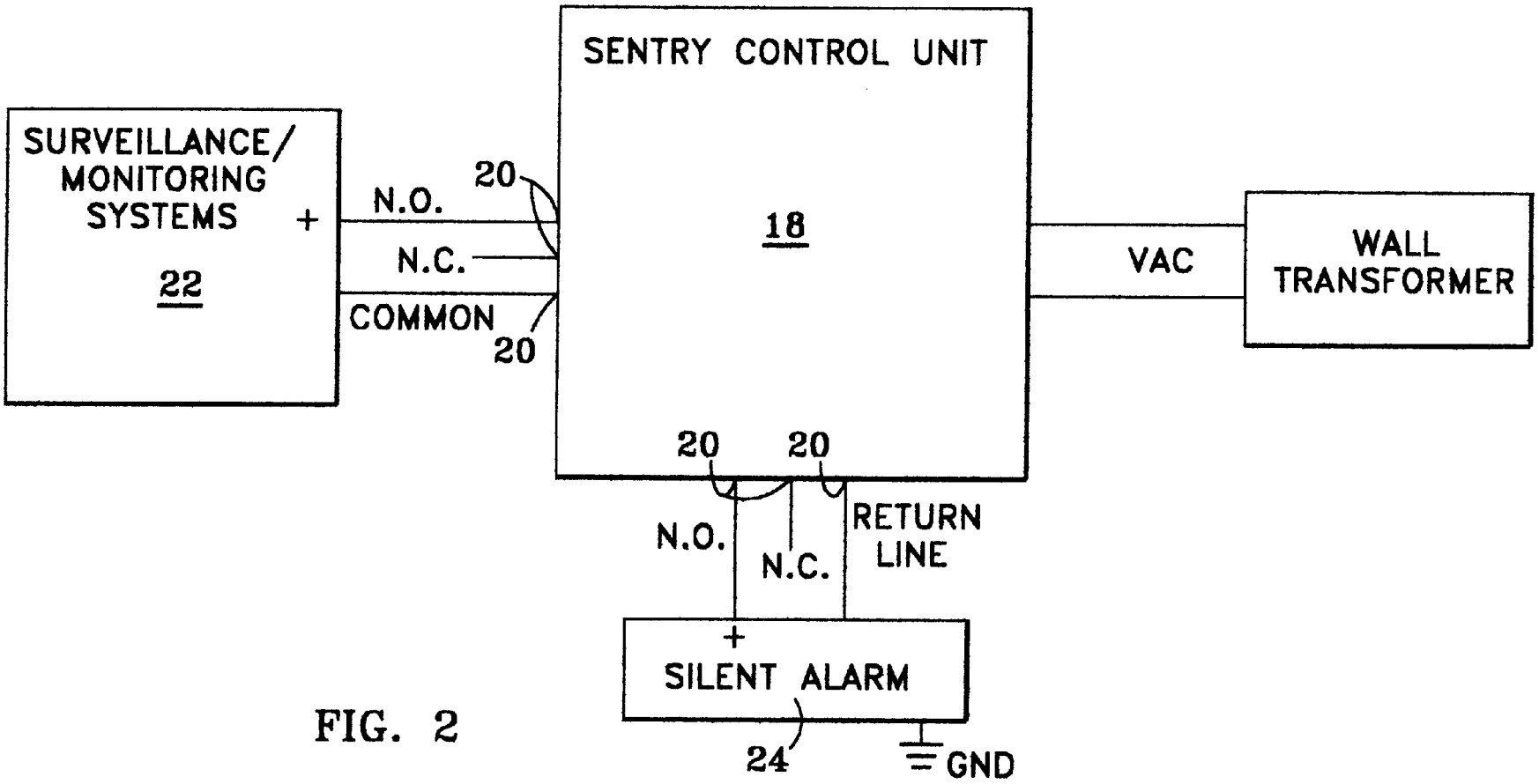
FIG. 2 is a schematic view of the Sentry Unit portion of the invention.

FIG. 2 shows a schematic view of a teller/cashier sentry unit 18 that is located near/within range (preferably radio signal range) of cash drawers housing the currency pack assembly 14. The teller sentry unit 18 has 12-volt electrical terminals 20 which are connectable to systems to automatically activate surveillance systems 22 and a silent alarm 24 immediately upon the currency pack assembly 14 being removed from the cash drawer. Teller sentry unit 18 is preferably a coded radio signal receiving only device whose functions are activated when currency pack assembly 14 is removed from the cash drawer. When connected but in an idle state the teller sentry unit 18 draws about 10 mA of current, but when fully relaying charges to outputs when activated, teller sentry unit 18 draws up to about 50 mA.

The currency pack assembly 14 further comprises preferably a chemical pack 12 and a microprocessor 14*a*, a transmitter 14*b* transmitting coded radio signals at a frequency of for example about 916 MHZ, a receiver 14*c* tuned to receive coded radio signals at a frequency of for example about 418 MHZ, and an encoder-decoder 14*d* which function similarly to the encoder-decoder electronics in door control unit 10. Instead of having a metal canister as with earlier types of systems, chemical pack 12 preferably houses, in a hollowed area of the currency pack assembly 14, pelletized CS teargas where allowed by law, colored pyrotechnic dye and smoke. Thus the currency pack assembly 14 has the look and feel of a real pack of currency, without the hard metal canister of some earlier systems.

FIGS. 3*a* and 3*b* are schematic views of the electronics of door control unit 10 and currency pack assembly 14 respectively, showing the similarity and compatibility of the electronics.

The entire system is activated when currency pack assembly 14 is removed from its resting site in a cash drawer. Upon removal, currency pack assembly 14 sends a coded signal that can be received by teller sentry unit 18 to instantly and automatically activate electronic devices such as, but not limited to, surveillance cameras and silent alarms that are electrically connected to the teller sentry unit 18. If the currency pack assembly 14 then enters the radio field of the door control unit 10 near the egress to the facility, the currency pack assembly 14 acknowledges the presence of the field, sending a coded signal to the decoder 10*d* of the door control unit 10. The decoder 10*d* then determines whether the signal contains the correct code to which it must respond. If the code being transmitted is correct, the coded signal is then passed to the microprocessor 14*a* within the currency pack assembly 14. The microprocessor 14*a* then monitors the signal continuously and triggers no other action until the coded signal is no longer detected.

At the same time, as currency pack assembly 14 is within the range of the coded radio signal being transmitted by the door control unit 10, and acknowledges that the signal has the correct code, the transmitter 14*b* of the currency pack assembly 14 itself sends a coded radio signal to the receiver 10*c* of the door control unit 10 alerting it that the currency pack assembly 14 is within its radio signal field. The decoder 10*d* within the door control unit 10 verifies the signal from the currency pack assembly 14 and passes it to the microprocessor 10*a* within the door control unit 10. Door control unit 10 then monitors the signal continuously and triggers no other action until the coded signal from the currency pack assembly 14 is no longer present.

When the two separate coded signals being transmitted and monitored by the door control unit 10 and the currency pack assembly 14 are no longer being received by each other, the currency pack assembly 14 has left the premises and is no longer physically within the range of the coded signal being transmitted by door control unit 10. Upon this absence of signals the following events occur.

A) The microprocessor 14*a* of currency pack assembly 14 triggers a counter which begins timing down to a time pre-determined by a user. At the end of the timing, the currency pack assembly 14 electronics send an electrical signal to an electric match embedded in a chemical film inside the currency pack assembly, thereby causing the chemical film to ignite at a level of heat causing the discharge of: colored dye over the paper currency within a bag or other container, colored smoke to pinpoint the location of the currency pack assembly, and CS tear gas that causes significant tearing, coughing and other extreme discomfort to any person within close range of the currency pack assembly 14. The aim is to compel the carrier of the currency pack assembly to discard the entire package.

B) At the same time, upon the absence of coded signals from the door control unit 10 and the currency pack assembly 14, the microprocessor 10*a* of door control unit 10 transmits an electrical signal to the silent or audible alarm 28 connected by wiring to door control unit 10. The alarm 28 is received by law enforcement or a monitoring center, as well as sounding audibly at the facility if there is an audible alarm connected. At the same time, a coded signal is sent to a system 30 to lock the doors of the facility so that the perpetrator cannot re-enter the facility. Individuals inside the facility can, however, leave without hindrance by pushing on a "panic bar". Procedures recommended by law enforcement and other authorities stipulate locking the door after perpetrators of a crime have left. The present system does not prevent anyone from leaving the premises but is designed to prevent re-entry, particularly by a perpetrator possibly angered by the ignition of the chemical pack 12.

The system of the present invention also includes a testing currency pack assembly and an ignition tester (both not shown) comprising essentially the same electronics as the actual system, and which enable the system to be tested right through to ignition of the chemical pack, but which do not detonate. Thus, the testing currency pack assembly and chemical pack allow the system to be tested without actually having to discharge any dyes or chemicals such as those contained in the chemical pack.

While the invention has been described with reference to a preferred embodiment, the foregoing description is illustrative only, and does not limit the scope of the invention. Those of ordinary skill in the art will see that there are possible variations in the equipment and function of the system that do not depart from the spirit and scope of the invention.

Accordingly, what is claimed is:

1. A system for deterring theft of paper currency comprising:

a coded transmitting and receiving door control unit, having an encoder-decoder, said door control unit located by the egress of a facility, wherein a door unit alarm and a door locking means are activatable by said door control unit;

an ignitable chemical pack enclosed within a currency pack assembly comprising a coded transmitting and receiving unit, having an encoder-decoder, said receiving unit in communication with said door control unit and also in communication with a coded transmitting and receiving teller sentry unit, having an encoder-decoder, said teller sentry unit located within the cashier area of said facility to signal immediately when said currency pack assembly leaves the cash drawer in which it is stored wherein a device chosen from the group consisting of: an audible alarm, a silent alarm and surveillance systems, is activatable by said teller sentry unit;

wherein said door locking means locks at least one pre-fitted door of the facility such that no one may enter the facility but wherein those inside the facility may exit wherein said door locking means is lockable upon receipt of a coded signal from said coded door control unit when the coded door control unit detects that the currency pack assembly has left the facility.

2. The system of claim 1 wherein said chemical pack inside said currency pack assembly contains and emits chemicals to stain bank notes with colored dye.

3. The system of claim 1 wherein said chemical pack contains pyrotechnic chemicals to emit a cloud of colored smoke to identify the location of stolen money.

4. The system of claim 3 wherein said chemical pack contains and emits tear gas agent to disable a person carrying said currency pack.

5. The system of claim 4 wherein said tear gas agent is orthochlorobenzalmalononitrile(CS) tear gas agent.

6. The system of claim 1 wherein said coded teller sentry unit has electrical terminals that are connectable to automatically activate said surveillance systems upon removal of said currency pack assembly from the cash drawer, in response to a coded signal transmitted to said coded teller sentry unit by said coded transmitting and receiving unit of said currency pack assembly.

7. The system of claim 6 wherein said surveillance systems are surveillance camera systems.

8. The system of claim 1 wherein said coded teller sentry unit has electrical terminals that are connectable to automatically activate said silent alarm upon removal of said currency pack assembly from the cash drawer, in response to a coded signal transmitted to it by said coded transmitting and receiving unit of said currency pack assembly.

9. The system of claim 1 wherein said coded teller sentry unit has electrical terminals that are connectable to automatically activate said audible alarm upon removal of said currency pack assembly from the cash drawer, in response to a coded signal transmitted to it by said coded transmitting and receiving unit of said currency pack assembly.

10. The system of claim 1 wherein said coded door control unit has electrical terminals that are connectable to automatically activate said door unit alarm when said coded door control unit receives signals from said coded transmitting and receiving unit of said currency pack assembly upon removal of said currency pack assembly from the facility.

11. The system of claim 1 wherein said door unit alarm is chosen from the group consisting of: a silent alarm and an audible alarm.

12. The system of claim 1 wherein said coded door control unit has electrical terminals that are connectable to automatically activate said door locking means when said coded door control unit receives coded signals from said coded transmitting and receiving unit of said currency pack assembly.

13. The system of claim 1 wherein said currency pack assembly further comprises a microprocessor which, when coded signals being transmitted by said coded door control unit and said coded transmitting and receiving unit of said currency pack assembly are no longer being received each by the other, signals said chemical pack that said currency pack assembly has left the facility and said microprocessor begins timing down to ignition of said chemical pack.

14. The system of claim 1 wherein said system further comprises a coded testing currency pack assembly for use with said system for testing said system.

15. The testing currency pack of claim 14 further comprises an ignition tester such that said system is testable completely through to ignition of said chemical pack.

16. The system of claim 1 wherein said coded door control unit, said coded transmitting and receiving unit of said currency pack assembly, and said coded teller sentry unit transmit and receive radio signals.

17. A method for preventing theft of paper currency from a facility, comprising the steps of:

detecting when a currency pack assembly has left a cash drawer where it is normally stored, transmitting a coded signal to a coded teller sentry unit indicating that said currency pack assembly has left the cash drawer, activating a silent alarm by a coded signal from said coded teller sentry unit to said silent alarm, detecting when said currency pack assembly has left the facility by having a coded door control unit which determines when said currency pack assembly exits the facility, sounding an audible alarm when said coded door control unit determines that said currency pack assembly has left the facility, locking the doors to the facility when said coded door control unit determines that said currency pack assembly has left the facility such that no one may enter the facility but such that individuals inside the facility may exit, initiating, when said coded door control unit has determined that said currency pack assembly has left the facility, a timing microprocessor to begin counting down to ignition of a chemical pack contained inside said currency pack assembly such that after a predetermined time, said chemical pack is ignited, and emitting colored dye, smoke, and teargas to disable a thief, thereby indicating the location of the thief and the stolen currency, marking the stolen currency such that it is readily identifiable, and causing the thief to drop the stolen currency.

* * * * *